US007767044B2

(12) United States Patent
Kamikawa et al.

(10) Patent No.: US 7,767,044 B2
(45) Date of Patent: Aug. 3, 2010

(54) METHOD FOR HEAT-TREATING STEEL MATERIAL

(75) Inventors: Mitsuru Kamikawa, Utsunomiya (JP); Hiroaki Yoshida, Nagoya (JP); Shigekazu Ito, Nagoya (JP)

(73) Assignee: Honda Motor Co., Ltd., Tokyo (JP)

( * ) Notice: Subject to any disclaimer, the term of this patent is extended or adjusted under 35 U.S.C. 154(b) by 654 days.

(21) Appl. No.: 11/662,661

(22) PCT Filed: Mar. 15, 2006

(86) PCT No.: PCT/JP2006/305077

§ 371 (c)(1),
(2), (4) Date: Mar. 13, 2007

(87) PCT Pub. No.: WO2006/098346

PCT Pub. Date: Sep. 21, 2006

(65) Prior Publication Data

US 2008/0210352 A1 Sep. 4, 2008

(30) Foreign Application Priority Data

Mar. 16, 2005 (JP) ..... 2005-075580
Mar. 9, 2006 (JP) ..... 2006-063437

(51) Int. Cl.
*C21D 8/00* (2006.01)
*C21D 9/40* (2006.01)

(52) U.S. Cl. ..... 148/660; 148/654

(58) Field of Classification Search ..... 148/589, 148/648, 649, 653, 654, 660, 320–336
See application file for complete search history.

(56) References Cited

U.S. PATENT DOCUMENTS 6,123,785 A 9/2000 Iguchi et al.

FOREIGN PATENT DOCUMENTS

| | | | | |
|---|---|---|---|---|
| CN | 85101950 | A | | 8/1986 |
| JP | 59-070718 | A | | 4/1984 |
| JP | 60-135519 | | * | 7/1985 |
| JP | 60-135519 | A | | 7/1985 |
| JP | 62-196321 | A | | 8/1987 |
| JP | 5-255739 | A | | 10/1993 |
| JP | 5-302117 | A | | 11/1993 |
| JP | 2524156 | B2 | | 5/1996 |
| JP | 11-302734 | A | | 11/1999 |
| JP | 2003-342687 | | * | 12/2003 |
| JP | 2005-120432 | | * | 5/2005 |
| JP | 2005-120432 | A | | 5/2005 |

* cited by examiner

*Primary Examiner*—George Wyszomierski
*Assistant Examiner*—Mark L Shevin
(74) *Attorney, Agent, or Firm*—Birch, Stewart, Kolasch & Birch, LLP

(57) ABSTRACT

Disclosed is an efficient heat treatment method which can be performed in a short time. Specifically disclosed is a method for heat-treating a steel material wherein a plastically deformed steel work is introduced into a heat treatment furnace when the work still retains the heat applied thereto during the plastic deformation, then the work is heated preferably at a heating rate of 15-50 DEG C./min and held at a temperature between Ac1 and Ac3 for 10 minutes or less, and then the work is slowly cooled at a cooling rate of 5-45 DEG C./min. This heat treatment method enables to easily produce a steel material having a uniform metal structure by simple facilities.

19 Claims, 13 Drawing Sheets

FIG. 11

| | C | Si | Mn | P | S | Cu | Ni | Cr | Mo | Ti | s-Al | s-B | OTHER COMPONENT |
|---|---|---|---|---|---|---|---|---|---|---|---|---|---|
| STEEL 1 | 0.48 | 0.05 | 0.28 | 0.009 | 0.010 | 0.10 | 0.04 | 0.11 | 0.01 | 0.038 | 0.032 | 0.0017 | – |
| STEEL 2 | 0.52 | 0.51 | 0.61 | 0.008 | 0.012 | 0.08 | 0.09 | 0.14 | 0.21 | 0.035 | 0.030 | 0.0016 | – |
| STEEL 3 | 0.48 | 0.25 | 1.41 | 0.017 | 0.035 | 0.12 | 0.06 | 0.17 | 0.02 | – | 0.021 | – | – |
| STEEL 4 | 0.40 | 0.33 | 1.13 | 0.023 | 0.104 | 0.16 | 0.05 | 0.16 | 0.01 | – | 0.023 | 0.0018 | 0.1V |
| STEEL 5 | 0.18 | 0.09 | 0.48 | 0.009 | 0.013 | 0.11 | 0.07 | 1.06 | 0.01 | 0.042 | 0.028 | – | 0.019Nb |
| STEEL 6 | 0.20 | 0.24 | 0.72 | 0.016 | 0.015 | 0.12 | 0.11 | 1.02 | 0.01 | – | 0.030 | – | – |
| STEEL 7 | 0.22 | 0.09 | 0.51 | 0.007 | 0.015 | 0.05 | 0.4 | 1.03 | 0.21 | – | 0.032 | – | – |
| STEEL 8 | 0.48 | 0.22 | 1.40 | 0.018 | 0.085 | 0.17 | 0.09 | 0.15 | 0.01 | 0.008 | 0.006 | – | 0.002Ca |
| STEEL 9 | 0.55 | 0.19 | 0.82 | 0.015 | 0.055 | 0.05 | 0.03 | 0.21 | 0.03 | – | 0.023 | – | 0.12Pb |
| STEEL 10 | 0.21 | 0.12 | 0.86 | 0.013 | 0.015 | 0.08 | 0.06 | 1.02 | 0.39 | – | 0.030 | – | 0.06Bi |
| STEEL 11 | 0.35 | 0.26 | 0.51 | 0.012 | 0.014 | 0.07 | 0.31 | 3.01 | 1.03 | – | 0.030 | – | – |

FIG. 12

| | STEEL TYPE | FORGING TEMPERATURE [°C] | HEATING HOLDING TEMPERATURE [°C] | COOLING RATE [°C/MINUTE] | SURFACE LAYER HARDNESS [Hv] | CENTER HARDNESS [Hv] | DIFFERENCE IN HARDNESS [Hv] |
|---|---|---|---|---|---|---|---|
| EXAMPLE 1 | STEEL 1 | 800 | 750 | 40 | 152 | 151 | 1 |
| EXAMPLE 2 | STEEL 1 | 800 | 765 | 40 | 155 | 150 | 5 |
| EXAMPLE 3 | STEEL 1 | 700 | 765 | 40 | 153 | 155 | -2 |
| EXAMPLE 4 | STEEL 1 | 700 | 765 | 10 | 146 | 141 | 5 |
| EXAMPLE 5 | STEEL 1 | 800 | 750 | 10 | 148 | 144 | 4 |
| EXAMPLE 6 | STEEL 2 | 800 | 765 | 40 | 163 | 159 | 4 |
| EXAMPLE 7 | STEEL 2 | 700 | 750 | 10 | 154 | 152 | 6 |
| EXAMPLE 8 | STEEL 3 | 850 | 750 | 10 | 162 | 158 | 4 |
| EXAMPLE 9 | STEEL 3 | 1150 | 760 | 40 | 167 | 164 | 3 |
| EXAMPLE 10 | STEEL 4 | 850 | 750 | 10 | 157 | 152 | 5 |
| EXAMPLE 11 | STEEL 4 | 1150 | 760 | 40 | 161 | 159 | 2 |
| EXAMPLE 12 | STEEL 5 | 450 | 750 | 10 | 142 | 142 | 0 |
| EXAMPLE 13 | STEEL 5 | 1150 | 750 | 40 | 149 | 146 | 3 |
| EXAMPLE 14 | STEEL 6 | 700 | 750 | 10 | 154 | 148 | 6 |
| EXAMPLE 15 | STEEL 7 | 1150 | 750 | 40 | 158 | 157 | 1 |
| EXAMPLE 16 | STEEL 7 | 700 | 750 | 10 | 155 | 150 | 5 |
| EXAMPLE 17 | STEEL 8 | 800 | 750 | 10 | 165 | 161 | 4 |
| EXAMPLE 18 | STEEL 9 | 800 | 765 | 10 | 156 | 151 | 5 |
| EXAMPLE 19 | STEEL 10 | 1150 | 750 | 40 | 157 | 154 | 3 |
| COMP. EX. 1 | STEEL 1 | 700 | 650 | 40 | 228 | 182 | 46 |
| COMP. EX. 2 | STEEL 1 | 800 | 850 | 40 | 187 | 162 | 25 |
| COMP. EX. 3 | STEEL 2 | 700 | 850 | 40 | 201 | 172 | 29 |
| COMP. EX. 4 | STEEL 5 | 200 | 500 | (AIR COOLING) | 244 | 207 | 37 |

FIG. 13

| STEEL TYPE | TEMPERATURE BEFORE INTRODUCTION INTO HEAT TREATMENT FURNACE [°C] | Ac1 POINT [°C] | Ac3 POINT [°C] | TEMPERATURE-RAISING RATE [°C/MINUTE] |
|---|---|---|---|---|
| STEEL 1 | 636.6 | 735.2 | ABOUT 770 | 24.85 |
| STEEL 2 | 620.4 | 732.1 | ABOUT 770 | 28.9 |
| STEEL 3 | 505.2 | 734.43 | ABOUT 770 | 45.8 |
| STEEL 4 | 609.6 | 732.3 | ABOUT 770 | 20.45 |
| STEEL 8 | 530.4 | 733.31 | ABOUT 770 | 25.44 |
| STEEL 9 | 644.3 | 734.3 | ABOUT 770 | 22.5 |
| STEEL 10 | 649.4 | 730.95 | ABOUT 760 | 16.72 |
| STEEL 11 | 629.8 | 724.9 | ABOUT 760 | 17.7 |

METHOD FOR HEAT-TREATING STEEL MATERIAL

TECHNICAL FIELD

The present invention relates to a heat treatment method to be carried out for a steel material to which plastic deformation processing is applied.

BACKGROUND ART

A constant velocity universal joint, which constitutes the running mechanism of an automobile, has an outer race member. In general, the outer race member is produced as follows. A workpiece made of carbon steel, which is a columnar member, is successively subjected to forward extrusion forming, upsetting forming, and backward extrusion forming, and finally the workpiece made of carbon steel is plastically deformed to have a shape of the outer race member. Before performing the forging processing as described above, the workpiece made of carbon steel may be heated to a predetermined temperature. That is, when the outer race member is produced, the warm forging or the hot forging may be performed.

The outer race member, which is formed and processed as described above, is cooled to room temperature, and then the outer race member is transported to some heat treatment equipment. In order to soften the outer race member and improve deformation ability in the heat treatment equipment, or in order to uniformize hardness, various types of heat treatments are carried out, including, for example, low temperature annealing, spheroidizing annealing, and normalizing.

Subsequently, shot blast treatment is performed to remove oxide scale or the like generated on the outer surface of the outer race member during the heat treatment. Further, lubricating chemical conversion coating, which is composed of zinc phosphate or the like, is formed on the outer surface. After that, ironing processing (sizing processing) is performed for the outer race member. Accordingly, the outer race member is finished to have a final dimension. The ironing processing is usually cold forging.

When the production process is carried out as described above, a large space is required in order to store the outer race member before applying the heat treatment. However, the reservation of the space for the purpose of the storage only is economically disadvantageous.

The heat treatment is performed, for example, while the outer race member, which is placed on a belt conveyer, is moved in a continuous type heating furnace. However, the period of time ranging from the entry of the outer race member into the continuous type heating furnace to the exit, in other words, the treatment time is long. For this reason, the production efficiency of the outer race member is low. Even when the furnace is changed to the batch type heating furnace, it is impossible to shorten the treatment time.

In any case, the heat treatment equipment for effecting the low temperature annealing, the spheroidizing annealing, and the normalizing is large. The investment in plant and equipment is high.

If the heat treatment is omitted in order to avoid the inconvenience as described above, then the outer race member is not softened, and also the hardness is not uniformized. Therefore, some breakage or crack may appear in the outer race member when the ironing processing is performed, and the dimension accuracy of teeth may be lowered when the teeth are provided on the shaft section of the outer race member.

In view of the above, it is desired to establish a heat treatment method which is completed in a short period of time and which can be carried out with simple equipment. For example, Japanese Laid-Open Patent Publication No. 5-302117 discloses a process in which only the tempering is performed while omitting the hardening. On the other hand, Japanese Laid-Open Patent Publication No. 5-255739 discloses a process in which a workpiece made of steel is subjected to plastic deformation processing at a processing rate of 45% to 65% at a temperature between the Ac1 and Ac3 points, followed by air cooling (natural cooling).

In the case of the heat treatment method described in Japanese Laid-Open Patent Publication No. 5-302117, the formed product, which is obtained after the forging processing, is subjected to natural cooling. Therefore, it is necessary to secure the space for storing the formed product. In other words, in the case of the heat treatment method described in Japanese Laid-Open Patent Publication No. 5-302117, it is impossible to reduce such storage space.

In Japanese Laid-Open Patent Publication No. 5-255739, the described processing method is warm forging. This method cannot be applied to a process in which cold forging or hot forging is performed.

For example, when the hot forging is performed, the phase in the metal microstructure causes transformation in the steel material which has the temperature lower than the temperature during the forging. Therefore, the metal microstructure sometimes becomes nonuniform. In this case, various characteristics of the steel material differ depending on the portions thereof. Therefore, a heat treatment method, which uniformizes the metal microstructure as homogeneously as possible, is desired. However, a heat treatment method has not been known, which makes it possible to uniformize the metal microstructure as homogeneously as possible and which is excellent in efficiency.

DISCLOSURE OF THE INVENTION

A general object of the present invention is to provide a heat treatment method for a steel material, in which the storage space for the steel material is unnecessary.

A principal object of the present invention is to provide an efficient heat treatment method which can be carried out in a short period of time.

Another object of the present invention is to provide a heat treatment method for a steel material, which can be carried out with simple equipment.

Still another object of the present invention is to provide a heat treatment method for a steel material, in which it is easy to uniformize the metal microstructure of a final product.

According to an aspect of the present invention, there is provided a heat treatment method for a steel material, comprising:

a first step of heating the steel material having processing heat as a result of application of plastic deformation processing, at a point of time at which the processing heat remains, such that the steel material is held at a temperature between Ac1 and Ac3 points; and a second step of cooling the steel material having been heated and held, at a cooling rate of 5° to 45° C./minute until arrival at a temperature at which precipitation of pearlite is completed, wherein a holding time in the first step is within 10 minutes.

After applying the plastic deformation processing, the metal microstructure may be slightly nonuniform in the steel material in which the temperature is lowered. In the present invention, the steel material is held at the temperature between the Ac1 and Ac3 points. Accordingly, the metal microstructure, in which austenite and ferrite coexist, is formed substantially uniformly or homogeneously in the steel material. That is, when the temperature is held or retained as described above, it is possible to substantially uniformize the metal microstructure of the steel material.

When the first step and the second step are performed, then the steel material is softened, and the hardness in the steel material is substantially equivalent irrelevant to the portions and the distances from the surface. In other words, all of the portions can be deformed in substantially equivalent degrees in the downstream processing such as ironing forming. Therefore, any crack is hardly generated in the formed product, and the dimensional accuracy of the formed product is satisfactory.

Further, in the present invention, the heat treatment is performed at the point of time at which the processing heat remains, i.e., at the point of time at which the so-called processing self-heat is possessed. Accordingly, it is unnecessary to store the steel material to which the plastic deformation processing has been applied. Therefore, it is unnecessary to prepare any space for the storage as well, and hence the space can be effectively utilized for any other way of use.

The holding time is within 10 minutes. Therefore, the scale of the heat treatment equipment can be decreased as compared with the conventional heat treatment equipment such as the equipment for the spheroidizing annealing. Accordingly, it is possible to avoid any high investment in plant and equipment. Further, the heat treatment efficiency is improved. Therefore, the energy, which is required for the heat treatment, is reduced, and the production efficiency is improved. Consequently, the present invention is advantageous in view of the cost.

In the present invention, the term "plastic deformation processing" includes the processing in which the pressure is applied to the steel material to cause the plastic deformation. Specifically, the plastic deformation processing is exemplified by the forging processing, the press forging processing, and the rolling processing, etc.

The temperature, at which the precipitation of pearlite is completed in the steel material, differs depending on the cooling rate in the second step and the type of the steel material. However, the temperature is generally within a range of 600° to 680° C. Therefore, it is sufficient that the second step is performed until arrival at 600° to 680° C.

It is preferable that the cooling rate in the second step is 5 to 10° C./minute. In this procedure, the microstructure is further made fine and minute. As a result, the unevenness of the hardness is further suppressed.

When the plastic deformation processing is performed while raising the temperature of the steel material to a temperature not lower than the Ac1 point, it is preferable that the heating (temperature raising) of the steel material is started at a point of time at which the temperature is not higher than an Ar1 point and not lower than 500° C.

The Ar1 point is defined as the temperature at which the eutectoid transformation from austenite to ferrite and cementite is started when the steel material is cooled. Therefore, the metal microstructure of the steel material, which is obtained when the temperature is lowered to not higher than the Ar1 point, is a substantially uniform microstructure containing ferrite and pearlite. Accordingly, the final metal microstructure of the steel material after the completion of the second step is further uniformized. It is possible to obtain the steel material in which various characteristics are substantially uniform in quality.

It is preferable that when the plastic deformation processing is performed while heating the steel material to a temperature lower than the Ac1 point, heating of the steel material is started at a point of time at which the temperature of the steel material is not lower than 500° C.

In the cold forging, it is preferable that the temperature raising is started at the point of time at which the processing self-heat is possessed, i.e., at the point of time at which the temperature is not lower than the temperature possessed before the application of the plastic deformation processing.

It is preferable that a temperature-raising rate is 15° to 50° C./minute until the steel material arrives at the temperature between the Ac1 and Ac3 points in the first step. If the temperature-raising rate is less than 15° C./minute, the heat treatment efficiency for the steel material is lowered. On the other hand, if the temperature-raising rate exceeds 50° C./minute, some defect may appear in the metal microstructure of the steel material.

Preferred examples of the steel material may contain, in mass %, at least 0.1% to 0.55% of C, 0.03% to 0.35% of Si, 0.2% to 1.0% of Mn, not more than 0.03% of P, not more than 0.03% of S, 0.03% to 1.15% of Cu, 0.01% to 1.15% of Ni, 0.1% to 1.2% of Cr, and not more than 0.45% of Mo. Other than the above, if necessary, it may also contain other elements including, for example, 0.03% to 0.05% of Ti, 0.02% to 0.04% of Al, 0.001% to 0.002% of B, about 0.1% of V, not more than 0.05% of Nb, not more than 0.05% of Ca, not more than 0.2% of Pb, and not more than 0.1% of Bi.

That is, representative steel material in the present invention may include carbon steel, boron steel, chromium steel, nickel chromium steel, nickel chromium molybdenum steel, manganese steel, and chromium manganese steel.

BRIEF DESCRIPTION OF THE DRAWINGS

FIG. 11 is a table illustrating composition ratios of steel materials of test pieces;

FIG. 12 is a table illustrating forging temperatures, heating holding temperatures, surface hardnesses, center hardnesses, and hardness differences concerning test pieces; and FIG. 13 is a table illustrating Ac1 points, Ac3 points, and temperature-raising rates of test pieces.

BEST MODE FOR CARRYING OUT THE INVENTION

The heat treatment method for the steel material according to the present invention will be explained in detail below with reference to the accompanying drawings as exemplified by a preferred embodiment concerning an exemplary case in which a workpiece of carbon steel is plastically deformed into an outer race member of a constant velocity universal joint by means of the forging processing after heating the workpiece to a temperature not lower than Ac1 point or a proper temperature which is lower than the Ac1 point.

Figure 1:
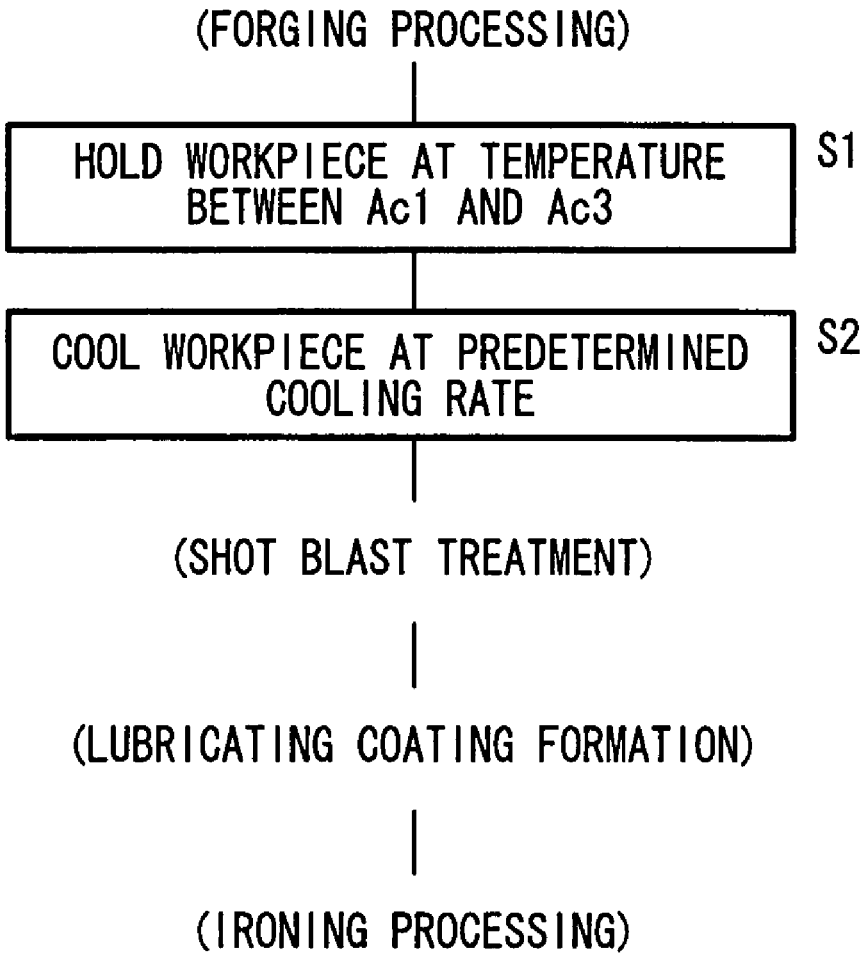
FIG. 1 is a flow chart illustrating a heat treatment method for a steel material according to an embodiment of the present invention.

The heat treatment method for a steel material according to the embodiment of the present invention is shown as a flow chart in FIG. 1. This heat treatment method includes a first step of holding the temperature of the outer race member (carbon steel) applied with the plastic deformation processing, at a temperature between Ac1 and Ac3 points, and a second step of cooling the outer race member after the completion of the heating and holding.

Figure 2A:
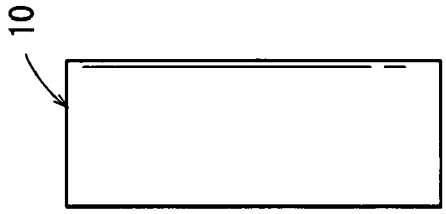
FIGS. 2A to 2E illustrate steps of plastic deformation into an outer race member from a workpiece.

The plastic deformation processing will be firstly explained. First, a columnar workpiece 10 of carbon steel shown in FIG. 2A is heated to a predetermined temperature. The temperature of the workpiece 10 may be, for example, 600° to 1,250° C. However, the transformation point of the carbon steel exists at a temperature higher than 720° C. and lower than 800° C. Therefore, it is preferable to avoid this temperature region. That is, it is preferable that the temperature of the workpiece 10 is 600° to 720° C. or 800° to 1,250° C.

Figure 2B:
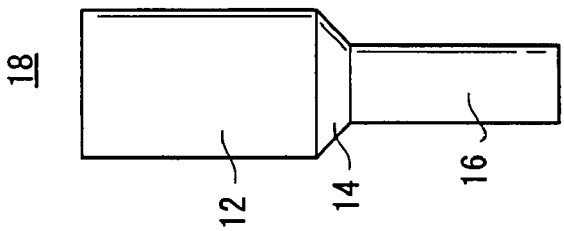
Figure 2C:
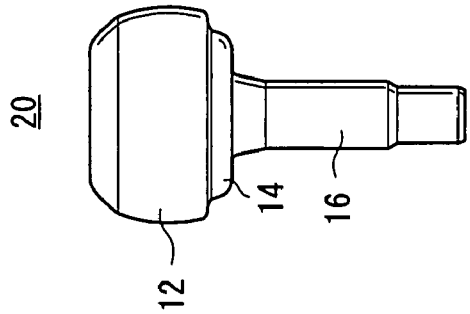

After that, the forward extrusion forming is applied to the workpiece 10. That is, while the workpiece 10 is supported on the side of one end surface, the workpiece 10 is pressed from the other end surface. Accordingly, the other end surface is deformed under the pressure. As a result, as shown in FIG. 2B, a primary formed product 18 is obtained, which is formed with a large diameter section 12, a reduced diameter section 14 having a tapered shape, and a shaft section 16. After that, the forward extrusion forming is performed again to provide a secondary formed product 20 as shown in FIG. 2C.

Figure 2D:
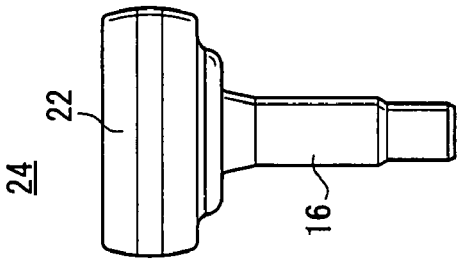

Subsequently, the upsetting forming is performed for the secondary formed product 20. Specifically, as shown in FIG. 2D, only the large diameter section 12 of the secondary formed product 20 is compressed, and thus the diameter of the large diameter section 12 is expanded to provide a tertiary formed product 24 having a cup section 22.

Figure 2E:
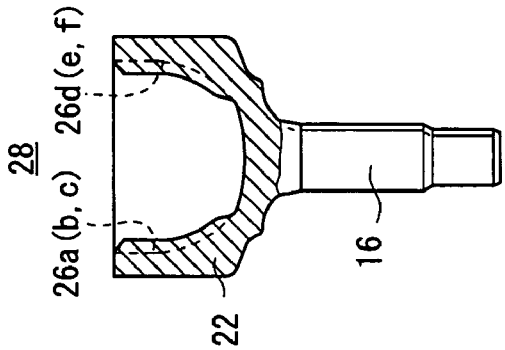

Subsequently, the backward extrusion forming is performed for the tertiary formed product 24, so that the cup section 22 is extended and six ball grooves 26*a* to 26*f* are formed on the cup section 22. That is, a punch, which has projections for forming the ball grooves 26*a* to 26*f*, abuts against a central portion of one end surface of the cup section 22, and then the forward end of the shaft section 16 is pressed to displace the tertiary formed product 24 while being directed to the punch. Accordingly, an outer race member 28 is obtained as shown in FIG. 2E.

The respective forging processing operations are performed with individual forging forming apparatuses. The workpiece 10, the primary formed product 18, the secondary formed product 20, and the tertiary formed product 24 are transported between the respective forging forming apparatuses by means of a transport apparatus such as a transfer machine.

Figure 3:
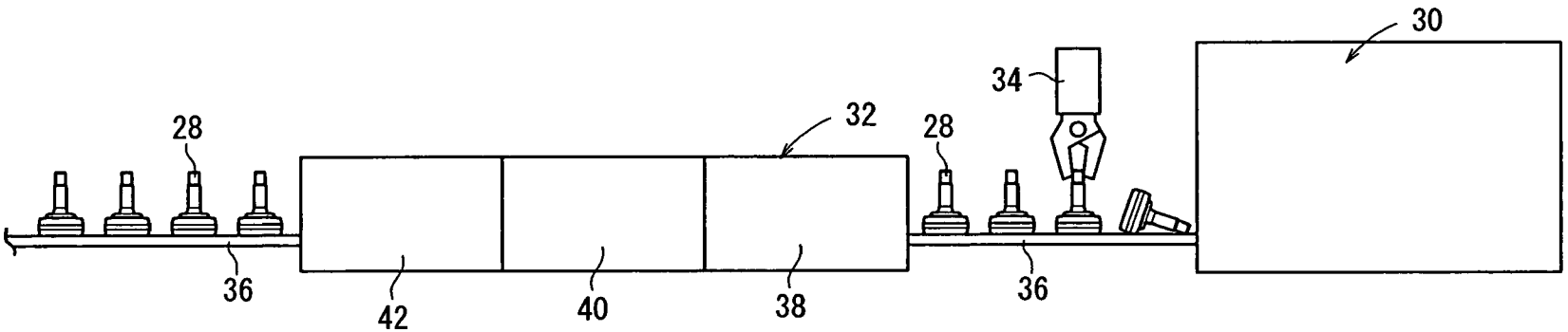
FIG. 3 schematically illustrates a work area for the transport of the outer race member from a forging process station to a heat treatment furnace.

As shown in FIG. 3, the outer race members 28, to which the forging processing has been applied as described above, are aligned by a robot 34 so that the shaft sections 16 are directed upwardly on a transfer machine 36 during the period of the transport from the forging processing station 30 to a heat treatment furnace 32.

As described above, the outer race member 28 is previously heated to a predetermined temperature before the forging processing is performed. The outer race member 28 has the processing heat at a high temperature as the forging processing is applied to cause plastic deformation.

In this embodiment, the outer race member 28 is introduced into the heat treatment furnace 32 at a point of time at which the high temperature is retained.

Figure 4:
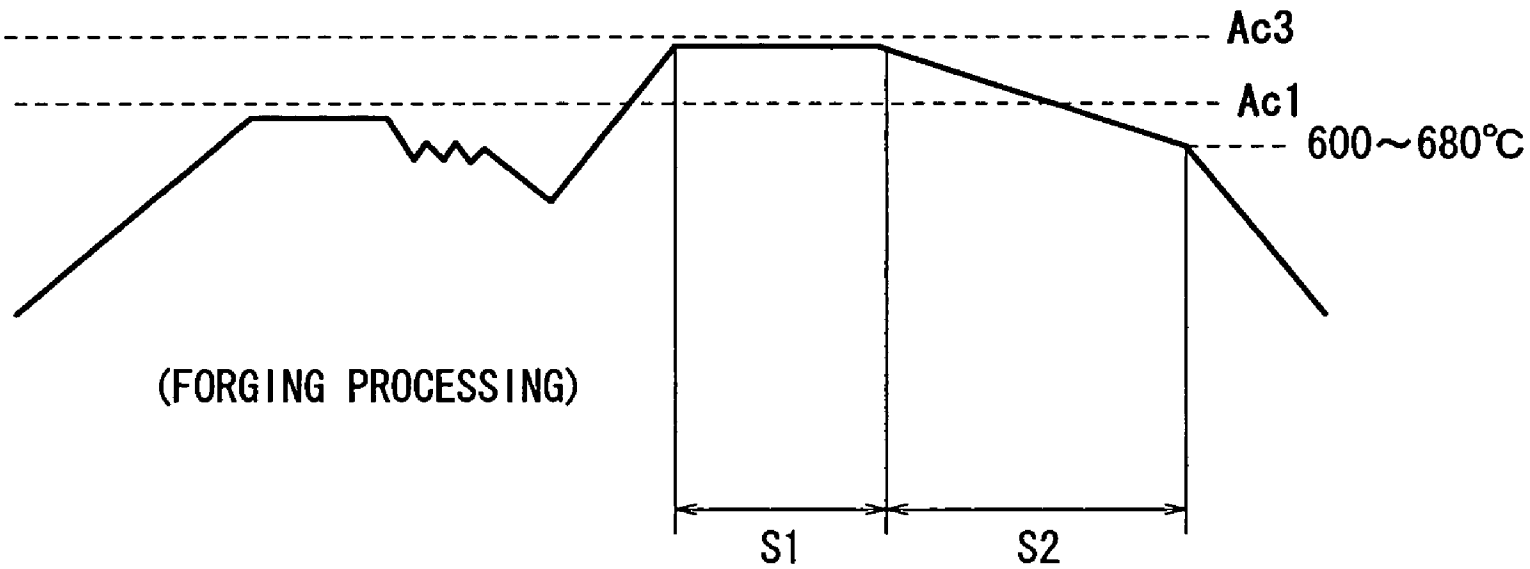
FIG. 4 is a graph illustrating a general temperature pattern when the forging processing is performed at a temperature lower than Ac1 point.
Figure 5:
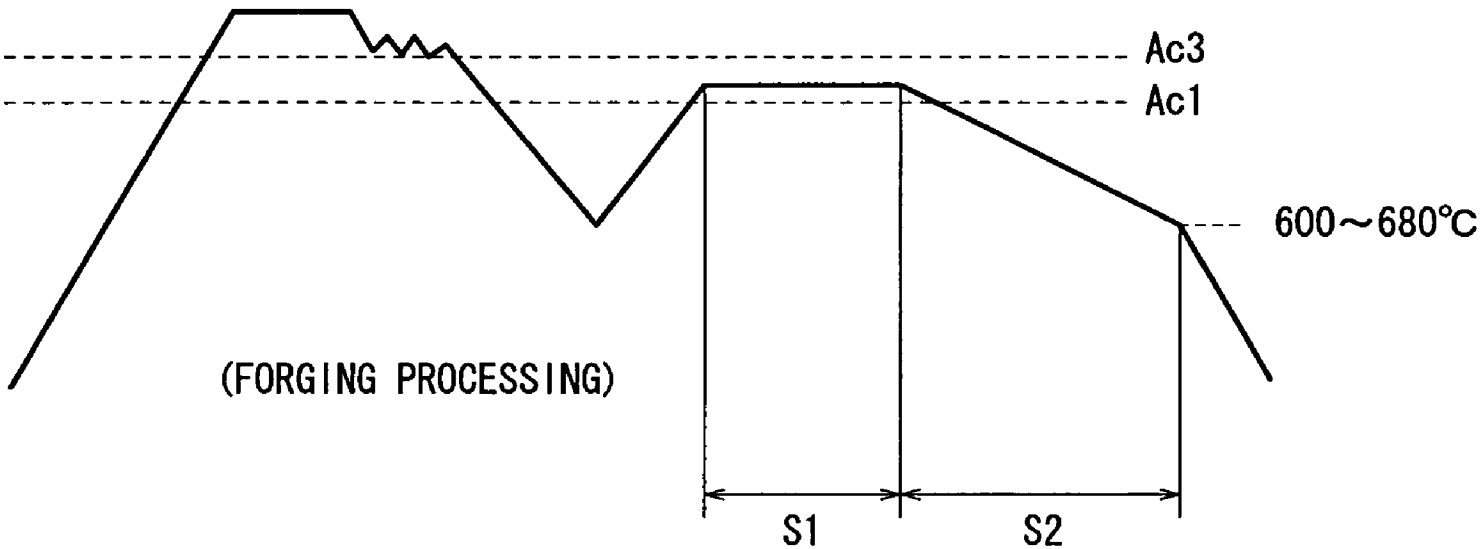
FIG. 5 is a graph illustrating a general temperature pattern when the forging processing is performed at a temperature not lower than the Ac1 point.

FIGS. 4 and 5 show general temperature patterns obtained when the forging processing is performed at a temperature lower than the Ac1 point or a temperature not lower than the Ac1 point, respectively. In particular, FIG. 4 shows the case in which the forging processing is performed at a relatively high temperature which is lower than the Ac1 point. In this case, the workpiece 10 has the temperature which is lower than the Ac1 point. Therefore, in the outer race member 28 obtained immediately after the completion of the backward extrusion forming, ferrite and pearlite are extended in the crystal grains.

When the forging processing is performed at the temperature pattern shown in FIG. 4, it is preferable that the temperature of the workpiece 10 during the forging processing is set to the value obtained by subtracting 180° C. from the numerical value of the Ac1 point, and more preferable that the temperature is set to the value obtained by subtracting 150° C. from the value of the Ac1 point, i.e., about 580° C.

On the other hand, FIG. 5 shows the case in which the forging processing is performed at a high temperature which exceeds the Ac1 point, and the outer race member 28 is introduced into the heat treatment furnace 32 after the temperature of the outer race member 28 is lower than the Ac1 point. As shown in FIG. 5, when the forging processing is performed at a high temperature which exceeds the Ac1, it is preferable that the temperature is set to a temperature not lower than the Ac3 point. In this case, the temperature of the workpiece 10 is above the Ac3 point at which the transformation of ferrite into austenite is completed. Therefore, austenite occupies the greater part of the metal microstructure of the outer race member 28 immediately after the completion of the backward extrusion forming. Since the metal microstructure is recrystallized, the transition is remarkably reduced in the metal microstructure. That is, when the temperature is set to a temperature of the Ac3 point or more, it is possible to further uniformize the metal microstructure of the steel material.

The distance from the forging processing station 30 to the heat treatment furnace 32 is set to be as short as possible (see FIG. 3) in order to quickly introduce the outer race member 28 applied with the forging processing into the heat treatment furnace 32. The velocity of the transport by the transfer machine 36 is set in conformity with the number of products of the outer race members 28 to be produced per unit time.

As described above, according to the embodiment of the present invention, the outer race member 28, which has the heat immediately after the plastic deformation, is introduced into the heat treatment furnace 32 as quickly as possible. Accordingly, it is unnecessary to provide any space for storing the outer race member 28. Therefore, the space can be effectively utilized for the other way of use.

The outer race member 28 is exposed to the atmospheric air during the period after being taken out from the die or the mold used for the backward extrusion forming until arrival at the heat treatment furnace 32. For this reason, the temperature of the outer race member 28 is slightly lowered. However, as described above, the outer race member 28 is introduced into the heat treatment furnace 32 in the state in which the high temperature is maintained.

It is preferable that the temperature of the outer race member 28 immediately before being introduced into the heat treatment furnace 32 is not lower than 500° C., regardless of whether the temperature of the workpiece is lower than the Ac1 point during the forging processing or not. If the outer race member 28, which has a temperature below 500° C., is introduced into the heat treatment furnace 32, it is necessary that the temperature-raising rate is set to be large, in order to raise the temperature to a temperature between the Ac1 and Ac3 points in a short period of time. However, in such a situation, some defect may appear in the metal microstructure due to the formation of coarse crystal grains. An obtained outer race member 28 is sometimes insufficient in the strength.

In order that the outer race member 28, which has the temperature lowered to a temperature below 500° C., is subjected to the temperature raising at a slow temperature-raising rate to avoid the above inconvenience, it is necessary that a large-scaled heat treatment furnace 32 is provided. In this case, the investment in plant and equipment is high.

When the forging processing is performed at a temperature not lower than the Ac1 point, the temperature of the outer race member 28 immediately before being introduced into the heat treatment furnace 32 is generally about 600° to 720° C. However, as shown in FIG. 5, the outer race member 28 may be introduced into the heat treatment furnace 32 at a point of time at which the temperature is lowered to a temperature which is below the Ar1 point as the starting temperature of the eutectoid transformation from austenite to ferrite and cementite during the cooling, for example, approximately to a temperature obtained by subtracting 50° C. from the numerical value of the Ar1 point, or further at a point of time at which the temperature is lowered to 500° C. In this case, austenite disappears from the metal microstructure of the outer race member 28. Therefore, it is easy to obtain the outer race member 28 in which the substantially homogeneous metal microstructure is formed while allowing ferrite and pearlite to coexist.

The numerical value of the Ar1 point is varied depending on the difference in the temperature-lowering rate, which is not constant. However, the numerical value of the Ar1 point is generally 710° to 720° C. when the temperature-lowering rate is 20° to 40° C./minute.

In this embodiment, the heat treatment furnace 32 has three furnaces, i.e., a temperature-raising furnace 38, a holding furnace 40, and a slow cooling furnace 42. In particular, the temperature-raising furnace 38 and the holding furnace 40 are retained at an identical temperature. $N_2$ gas may be introduced into the three furnaces to perform the heating, the holding, and the slow cooling in the $N_2$ atmosphere.

The outer race member 28 is firstly introduced into the temperature-raising furnace 38 in the state of being placed on the transfer machine 36 to start the first step S1 shown in FIG. 1.

The outer race member 28, which has been introduced into the temperature-raising furnace 38, is heated until arrival at the temperature between the Ac1 and Ac3 points.

In this situation, as described above, if the temperature-raising rate is set to be extremely large, some defect may appear in the metal microstructure because crystal grains become coarse. In order to avoid this inconvenience, it is preferable that the temperature of the temperature-raising furnace 38 is set so that the temperature-raising rate is not more than 50° C./minute. If the temperature-raising rate is less than 15° C./minute, the heat treatment efficiency is lowered for the outer race member 28. In order not to decrease the heat treatment efficiency even when the temperature-raising rate is less than 15° C./minute, it is necessary that the heat treatment furnace 32 should be large. Therefore, the investment in plant and equipment is high. Consequently, the preferred temperature-raising rate is 15° to 50° C./minute. More preferably, the temperature-raising rate is 17° to 46° C./minute.

In order to obtain the temperature-raising rate as described above, the temperature of the temperature-raising furnace 38 is set to 800° to 850° C. in this embodiment. For example, the outer race member 28, which has had a temperature of 500° to 720° C. before being introduced into the temperature-raising furnace 38, arrives at a temperature of 720° to 780° C. before the outer race member 28 passes through the temperature-raising furnace 38.

The outer race member 28, which has passed through the temperature-raising furnace 38, is subsequently introduced into the holding furnace 40. In the holding furnace 40, the outer race member 28, which has had the temperature of about 720° to 780° C. raised in the temperature-raising furnace 38, is held at that temperature.

It is enough that the temperature raising and the holding are performed within 10 minutes in total. If the heat treatment is performed in a period of time longer than the above, the heat treatment equipment is large-scaled, because the heat treatment furnace 32 and the transfer machine 36 are elongated. In other words, the investment in plant and equipment is high. Even when the heating and the holding are performed in a period of time longer than 10 minutes, the degree of softening and uniformity of hardness is almost equivalent to that obtained within 10 minutes. Therefore, such a procedure is disadvantageous in view of the cost. It is enough that the period of time, which is required for the temperature raising and the holing, is within 5 minutes in total. For example, the period of time may be 3 minutes.

The outer race member 28, which is held at the temperature between the Ac1 and Ac3 points, has the metal microstructure in which austenite and ferrite coexist.

Figure 6:
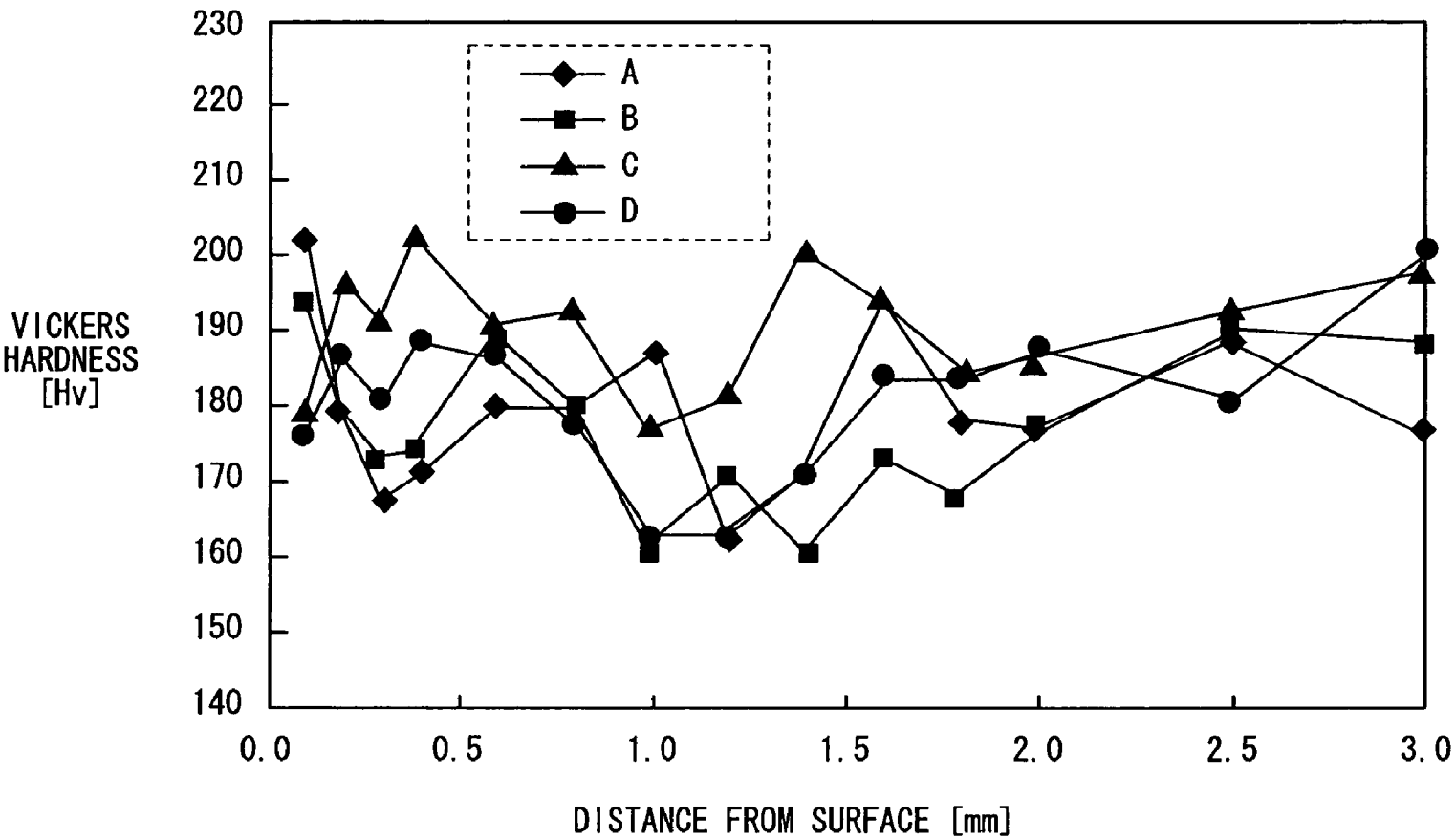
FIG. 6 is a graph illustrating the unevenness of hardness of a shaft section when the temperature is raised and held at a temperature exceeding Ac3.
Figure 7:
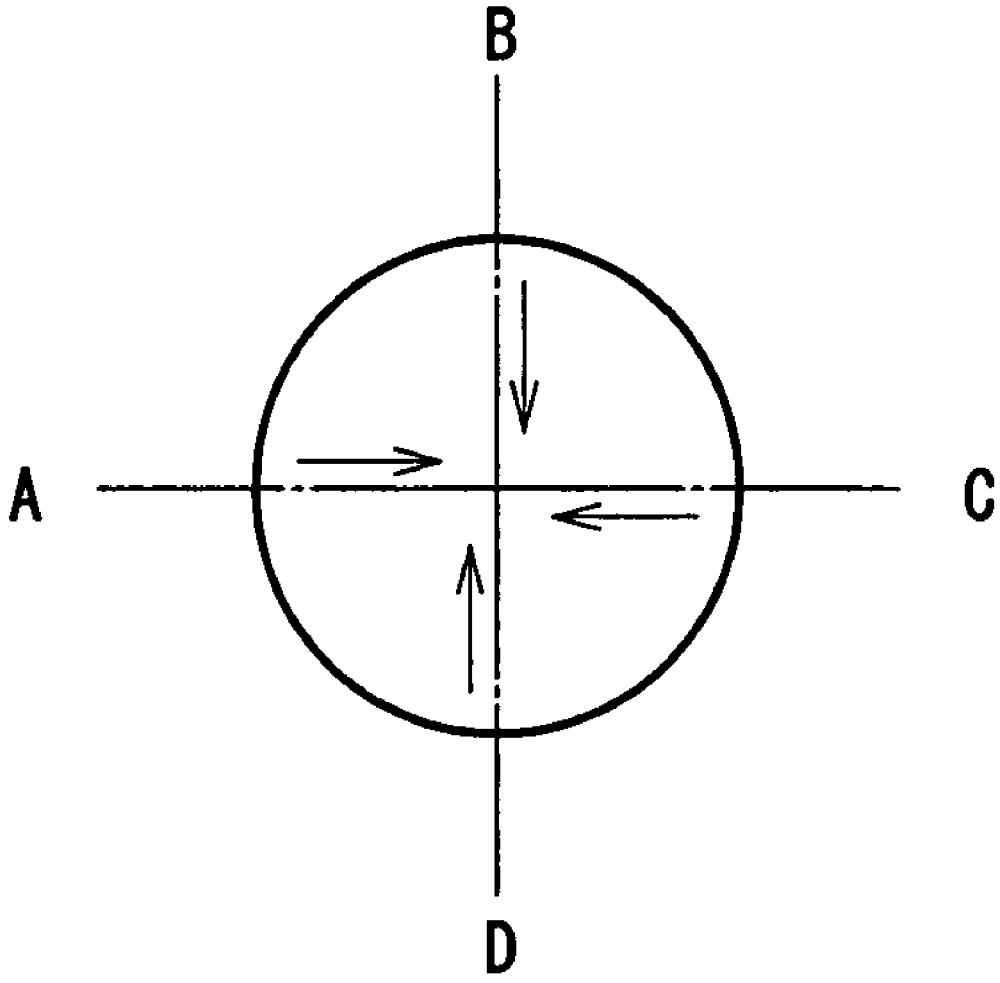
FIG. 7 is a horizontal sectional view taken at a position of 50 mm from the end of the shaft section to illustrate the portions A to D shown in FIG. 6.

If the final temperature of the outer race member 28 is lower than the Ac1 point, then it is difficult to soften the outer race member 28, and it is difficult to uniformize the hardness. If the temperature is raised and held until arrival at a temperature exceeding the Ac3 point, the coarse grains of austenite are formed (abnormal grain growth). For this reason, as shown in FIG. 6, it is recognized that the hardness is uneven in the different portions or depending on the distance from the surface. The symbols A to D shown in FIG. 6 indicate the measured values obtained for the portions A to D disposed at positions of 50 mm from the end of the shaft section 16 as shown in FIG. 7. The respective values are measured in the directions directed from the surface to the interior in the horizontal cross section. This procedure is adopted equivalently in the following.

The outer race member 28, which has been subjected to the heating and the holding as described above, is subsequently introduced into the slow cooling furnace 42 to start the second step S2 thereby.

Figure 8:
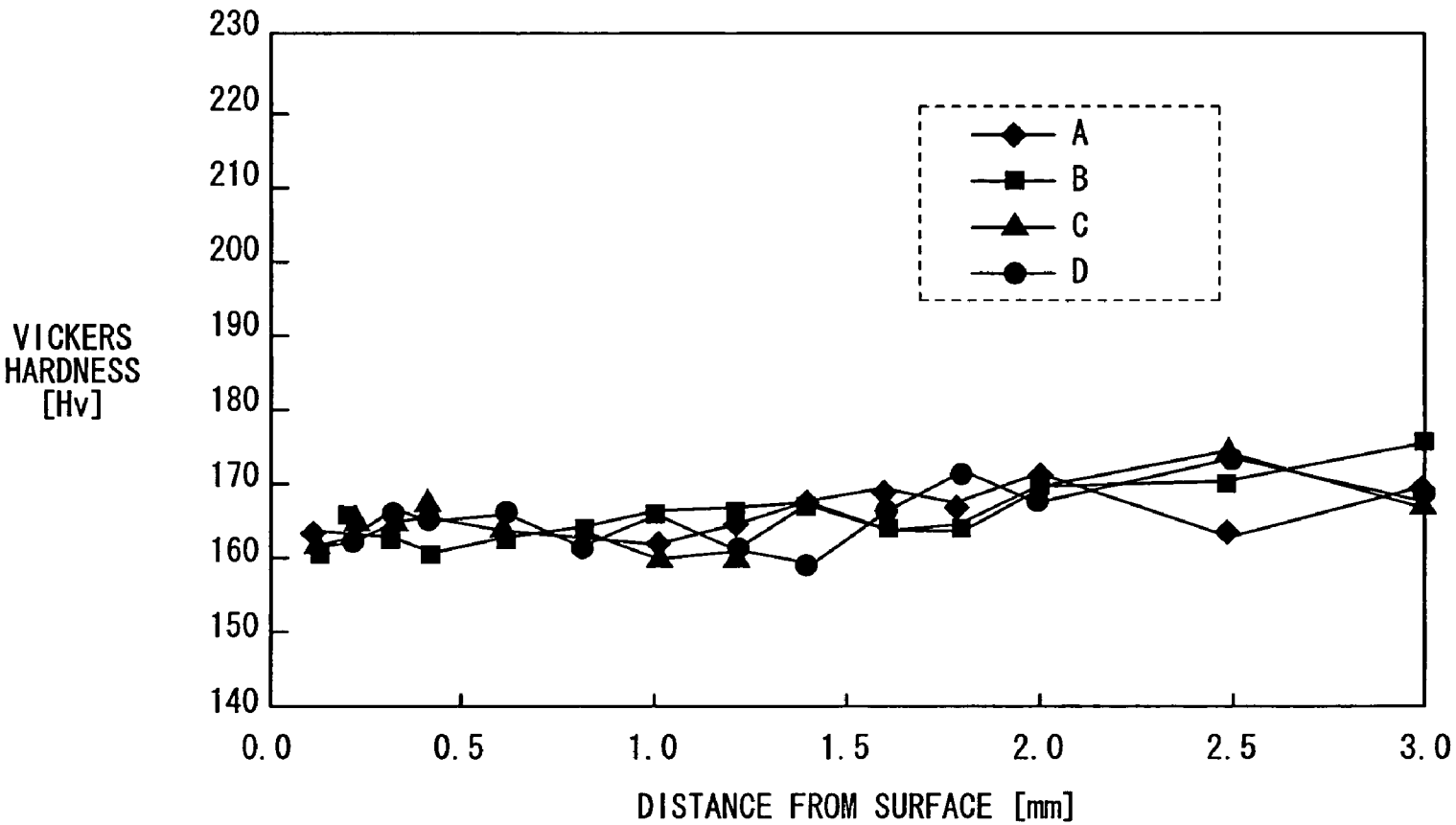
FIG. 8 is a graph illustrating hardnesses obtained in the direction from the surface to the interior of the shaft section of the outer race member after performing the second step.

In the slow cooling furnace 42, the cooling rate of the outer race member 28 is set to be within a predetermined range, specifically to 5° to 45° C./minute. When the cooling rate is set to be within the range as described above, the microstructure, which is substantially homogeneous from the surface to the interior, is obtained. As shown in FIG. 8, the unevenness of the hardness is scarcely observed.

Figure 9:
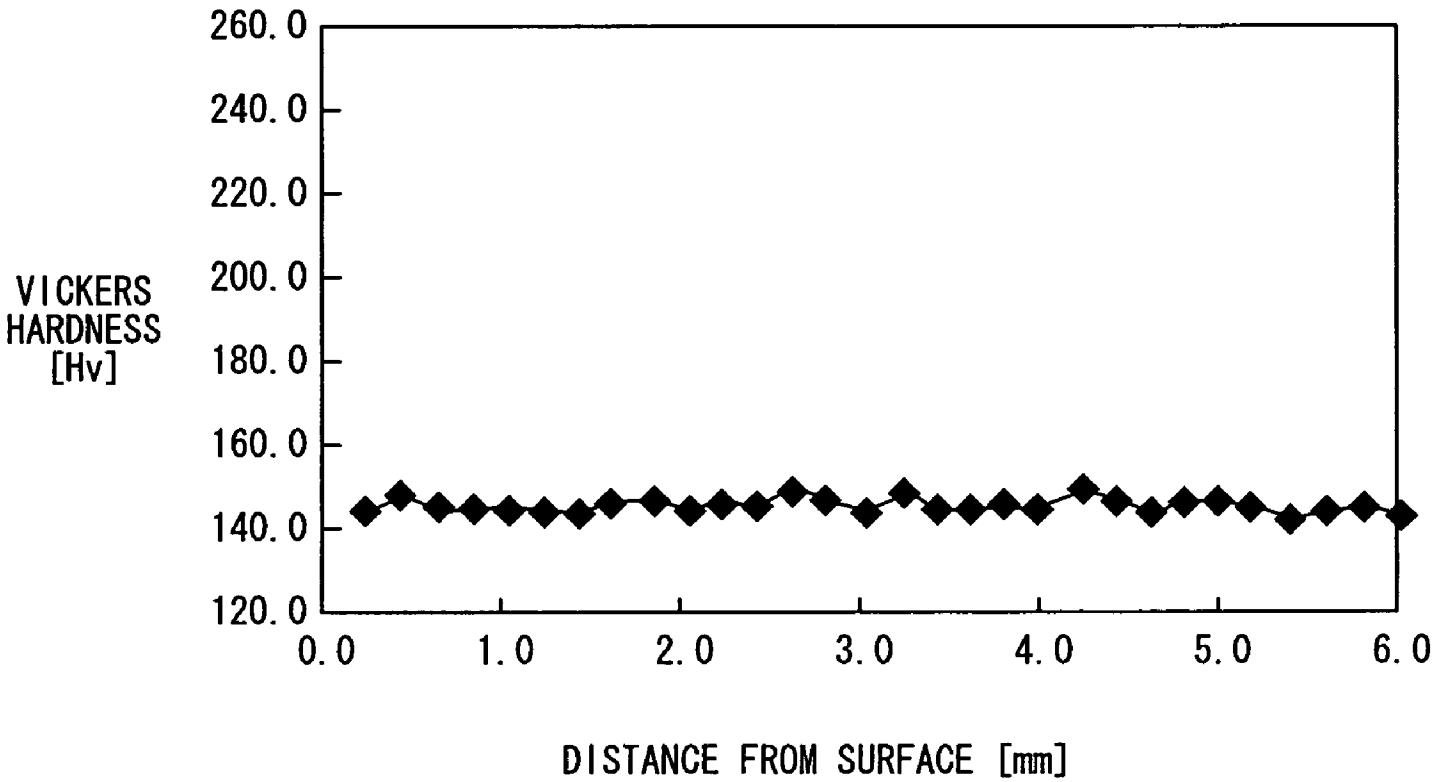
FIG. 9 is a graph illustrating hardness obtained in the direction from the surface to the interior of the shaft section of the outer race member when the cooling rate in the second step is 5° to 10° C./minute.

It is more preferable that the cooling rate is 5° to 10° C./minute. In this case, the spheroidal microstructure is formed. As shown in FIG. 9, the hardness ranging from the surface to the interior is more homogeneous, and the elongation and drawing performance of the outer race member 28 is improved.

Figure 10:
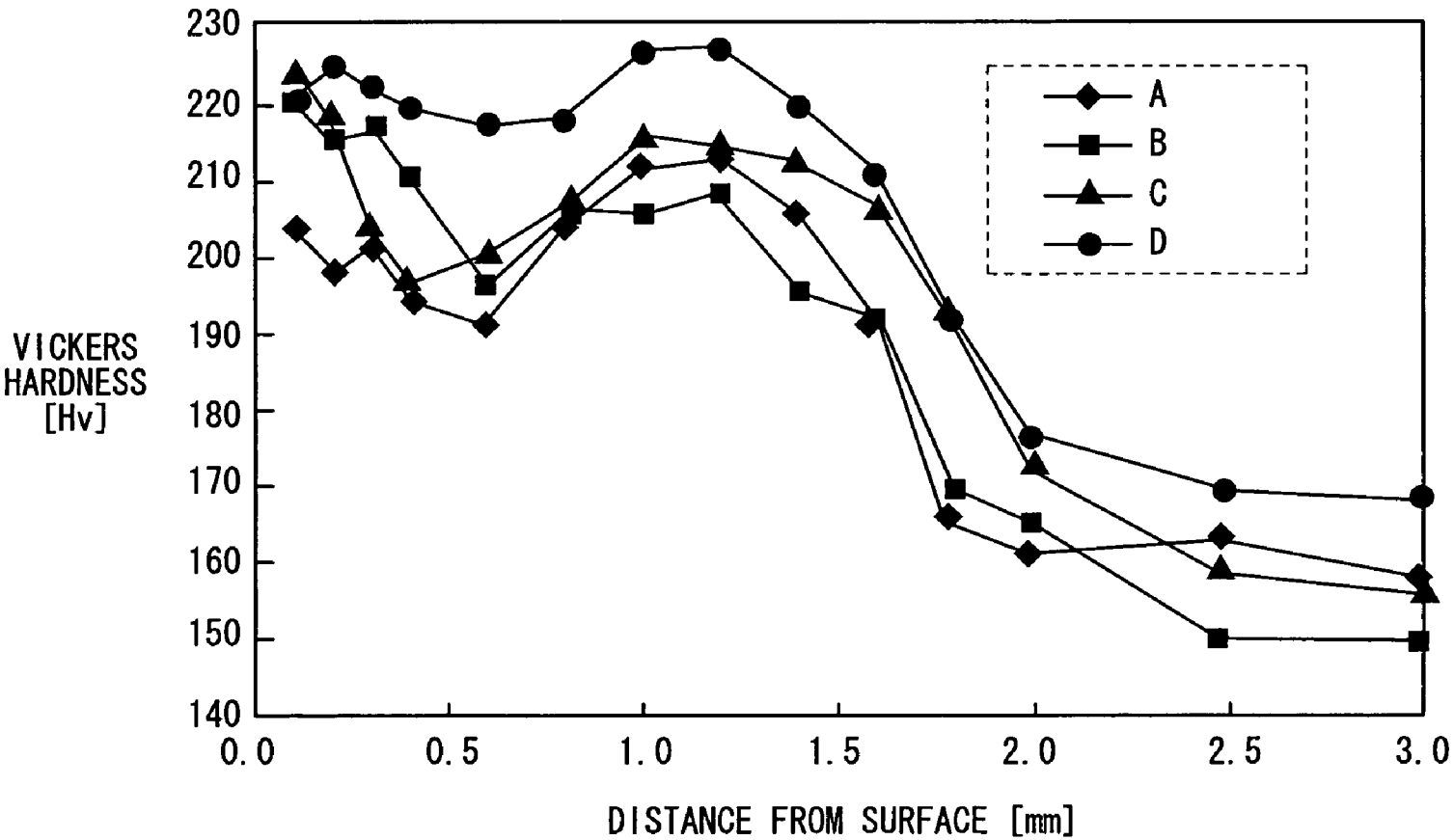
FIG. 10 is a graph illustrating hardnesses obtained in the direction from the surface to the interior of the shaft section of the outer race member when the heat treatment is not applied after the forging processing.

The hardness, which is obtained in an outer race member 28 not subjected to the heat treatment after the forging processing, is shown in FIG. 10. When FIGS. 8 and 9 are compared with FIG. 10, it is clear that the outer race member 28 is softened by applying the heat treatment according to the embodiment of the present invention, and the unevenness of the hardness can be suppressed in the outer race member 28.

It is sufficient that the slow cooling is performed until arrival at a temperature at which the precipitation of pearlite is completed. The precipitation completion temperature differs depending on the temperature-lowering rate and the type of the steel material. However, the precipitation completion temperature is generally between 680° and 600° C. Therefore, it is preferable that the slow cooling is continued until the temperature is between 680° and 600° C. For example, it is sufficient that the slow cooling is performed until the temperature is lowered to 650° C. As the temperature is lowered as described above, the metal microstructure, in which ferrite and pearlite coexist, is formed in the outer race member 28.

As described above, in the embodiment of the present invention, the outer race member 28 passes through the temperature-raising furnace 38, the holding furnace 40, and the slow cooling furnace 42 in a short period of time. Therefore, the heat treatment equipment, which ranges from the temperature-raising furnace 38 to the slow cooling furnace 42, is constructed simply.

The outer race member 28, for which the second step S2 has been completed, is carried out from the slow cooling furnace 42 by means of the transfer machine 36. The outer race member 28 is cooled to room temperature. After that, the shot blast treatment and the lubricating chemical conversion coating-forming treatment are performed. The outer race member 28 is transported to the forging processing station in which the ironing forming is to be performed.

In the ironing forming, the outer race member 28 is easily deformed, because the elongation and drawing performance of the outer race member 28 is improved. The hardness of the outer race member 28 is substantially equivalent irrelevant to the various portions. Further, the hardness of the outer race member 28 is substantially constant ranging from the surface to the interior. Accordingly, the deformation ability is substantially equivalent for all of the portions. Therefore, the degree of deformation is substantially equivalent as well. Accordingly, it is possible to manufacture the outer race member 28 which is excellent in the dimensional accuracy even at portions having relatively small shapes, for example, such as teeth.

The foregoing embodiment has been explained as exemplified by the case in which the workpiece of carbon steel is plastically deformed into the outer race member 28 of the constant velocity universal joint by means of forging processing at a temperature which is lower or not lower than the Ac1 point. However, it goes without saying that the present invention is not especially limited thereto. For example, the workpiece may be a steel material other than carbon steel, such as boron steel, chromium steel, nickel chromium steel, nickel chromium molybdenum steel, manganese steel, or chromium manganese steel. The workpiece may be free cutting steel added with a free cutting component such as Pb. Further, any product other than the outer race member 28 may be manufactured as the final product.

Cold forging may be applied to a workpiece made of steel. In this case, the workpiece made of steel will also have the processing heat in accordance with the plastic deformation. The heat treatment may be performed as described above for the workpiece made of steel at a point of time at which the processing heat is held, in other words, at a point of time at which the temperature is higher than the temperature before applying the plastic deformation processing.

The plastic deformation processing is not limited to the forging processing. Any processing in which the pressure is applied to the workpiece to deform the workpiece may be included. For example, the rolling processing is included.

FIRST WORKING EXAMPLE

Column-shaped test pieces having diameter of 23.8 mm×length of 48 mm, which were composed of respective steels 1 to 10 having compositions shown in FIG. 11 (numerals indicate mass %), were manufactured. The test pieces were subjected to the temperature raising to a predetermined temperature by means of a high frequency heating apparatus, and the temperature was held for 1 minute. After that, the temperature was lowered by 50° C. by means of the air cooling. After that, the forward extrusion forming was carried at a surface reduction ratio of 65%. In FIG. 11, the symbol "s-" affixed to the head of the name of the element means the fact that the element exists in a state of solid solution in the steel material.

Subsequently, the test pieces, which had the temperature lowered to 600° C., were introduced into the heat treatment furnace, which were heated to and held at a predetermined temperature. Further, the test pieces were slowly cooled to 680° C. while controlling the cooling rate. The test pieces were taken out from the heat treatment furnace, and then left to be cooled until arrival at room temperature.

After that, the Vickers hardness was measured at three points at the central portion and at the position of a depth of 0.5 mm from the surface of the extrusion portion to calculate the average value. The difference between the surface layer hardness and the center hardness was calculated.

FIG. 12 collectively shows the forging temperature, the heating and holding temperature, the cooling rate, the surface layer hardness, the center hardness, and the difference in hardness as obtained as described above. The lower surface layer hardness and the smaller difference in hardness mean the fact that any crack hardly appears in the ironing forming, and the dimensional accuracy after the forming is satisfactory.

For the purpose of comparison, the heat treatment was applied to test pieces having the same size provided that the heating and holding temperature was lower than the Ac1 point or higher than the Ac3 point (Comparative Examples, COMP. EX. 1 to 4). FIG. 12 also shows the heating and holding temperature, the cooling rate, the surface layer hardness, the center hardness, and the difference in hardness as obtained in this case. According to FIG. 12, it is clear that the difference in hardness is large in the test pieces of Comparative Examples.

SECOND WORKING EXAMPLE

Test pieces, which had the same size as those of the steels 1 to 4 and the steels 8 to 11 shown in FIG. 11, were manufactured. The respective test pieces were individually heated, and then they were subjected to air cooling until the temperatures were lowered to a predetermined temperature. Further, each of the test pieces was heated at a predetermined temperature-raising rate until arrival at a temperature between the respective Ac1 and Ac3 points shown in FIG. 13. The lowered temperatures and the temperature-raising rates are shown in FIG. 13 in combination.

The test pieces were held at the temperature between the Ac1 and Ac3 points, and then the test pieces were slowly cooled to 650° C. while controlling the cooling rate. After that, the test pieces were taken out from the heat treatment furnace, and then left to be cooled until arrival at room temperature. The metal microstructure of each of the test pieces was observed by using a scanning type electron microscope. As a result, it was confirmed that the metal microstructure was a substantially homogeneous microstructure of ferrite and pearlite, in which any defect was hardly present.

The invention claimed is:

1. A heat treatment method for a steel material, comprising:

a first step of heating said steel material having processing heat as a result of application of plastic deformation processing, at a point of time at which the processing heat remains, such that said steel material is held at a temperature between an Ac1 point and an Ac3 point, wherein a temperature-raising rate is 15° to 50° C./minute until arrival at said temperature between said Ac1 and Ac3 point; and a second step of cooling said steel material having been heated and held, at a cooling rate of 5° to 45° C./minute until arrival at a temperature at which precipitation of pearlite is completed wherein, a holding time in said first step is within 10 minutes.

2. The heat treatment method according to claim 1, wherein said second step is performed until said steel material has a temperature of 600° to 680° C.

3. The heat treatment method according to claim 1, wherein said cooling rate in said second step is 5° to 10° C./minute.

4. The heat treatment method according to claim 1, wherein said plastic deformation processing is performed while heating said steel material to a temperature not lower than said Ac1 point, and heating of said steel material is started at a point of time at which said temperature of said steel material is not higher than an Ar1 point and not lower that 500° C. in said first step.

5. The heat treatment method according to claim 1, wherein said plastic deformation processing is performed while heating said steel material to a temperature lower than said Ac1 point, and heating of said steel material is started at a point of time at which said temperature of said steel material is not lower than 500° C. in said first step.

6. The heat treatment method according to claim 1, wherein said steel material contains, in mass %, at least 0.1% to 0.55% of C, 0.03% to 0.35% of Si, 0.2% to 1.0% of Mn, not more than 0.03% of P, not more than 0.03% of S, 0.03% to 0.15% of Cu, 0.01% to 0.15% of Ni, 0.1% to 1.2% of Cr, and not more than 0.45% of Mo.

7. The heat treatment method according to claim 6, wherein said steel material is carbon steel, boron steel, chromium steel, nickel chromium steel, nickel chromium molybdenum steel, manganese steel, or chromium manganese steel.

8. A heat treatment method for a steel material, comprising:

a first step of heating said steel material having processing heat as a result of application of plastic deformation processing, at a point of time at which the processing heat remains, such that said steel material is held at a temperature between an Ac1 point and an Ac3 point; and a second step of cooling said steel material having been heated and held, at a cooling rate of 5° to 10° C./minute until arrival at a temperature at which precipitation of pearlite is completed wherein, a holding time in said first step is within 10 minutes.

9. The heat treatment method according to claim 8, wherein said second step is performed until said steel material has a temperature of 600° to 680° C.

10. The heat treatment method according to claim 8, wherein said plastic deformation processing is performed while heating said steel material to a temperature not lower than said Ac1 point, and heating of said steel material is started at a point of time at which said temperature of said steel material is not higher than an Ar1 point and not lower than 500° C. in said first step.

11. The heat treatment method according to claim 8, wherein said plastic deformation processing is performed while heating said steel material to a temperature lower than said Ac1 point, and heating of said steel material is started at a point of time at which said temperature of said steel material is not lower than 500° C. in said first step.

12. The heat treatment method according to claim 8, wherein a temperature-raising rate is 15° to 50° C./minute until arrival at said temperature between said Ac1 and Ac3 points in said first step.

13. The heat treatment method according to claim 8, wherein said steel material contains, in mass %, at least 0.1% to 0.55% of C, 0.03% to 0.35% of Si, 0.2% to 1.0% of Mn, not more than 0.03% of P, not more than 0.03% of S, 0.03% to 0.15% of Cu, 0.01% to 0.15% of Ni, 0.1% to 1.2% of Cr, and not more than 0.45% of Mo.

14. The heat treatment method according to claim 13, wherein said steel material is carbon steel, boron steel, chromium steel, nickel chromium steel, nickel chromium molybdenum steel, manganese steel, or chromium manganese steel.

15. A heat treatment method for a steel material, comprising:

a first step of heating said steel material having processing heat as a result of application of plastic deformation processing, at a point of time at which the processing heat remains, such that said steel material is held at a temperature between an Ac1 point and an Ac3 point; and a second step of cooling said steel material having been heated and held, at a cooling rate of 5° to 45° C./minute until arrival at a temperature at which precipitation of pearlite is completed wherein, a holding time in said first step is within 10 minutes and said plastic deformation processing is performed while heating said steel material to a temperature lower than said Ac1 point, and heating of said steel material is started at a point of time at which said temperature of said steel material is not lower than 500° C. in said first step.

16. The heat treatment method according to claim 15, wherein said second step is performed until said steel material has a temperature of 600° to 680° C.

17. The heat treatment method according to claim 15, wherein said cooling rate in said second step is 520 to 10° C./minute.

18. The heat treatment method according to claim 15, wherein said steel material contains, in mass %, at least 0.1% to 0.55% of C, 0.03% to 0.35% of Si, 0.2% to 1.0% of Mn, not more than 0.03% of P, not more than 0.03% of S, 0.03% to 0.15% of Cu, 0.01% to 0.15% of Ni, 0.1% to 1.2% of Cr, and not more than 0.45% of Mo.

19. The heat treatment method according to claim 18, wherein said steel material is carbon steel, boron steel, chromium steel, nickel chromium steel, nickel chromium molybdenum steel, manganese steel, or chromium manganese steel.

* * * * *